United States Patent [19]

Kuhn et al.

[11] Patent Number: 4,492,127

[45] Date of Patent: Jan. 8, 1985

[54] MOTOR-COMPRESSOR UNIT

[75] Inventors: Gerhard Kuhn, Cypress, Calif.; John J. Jacobs, Flint, Tex.

[73] Assignee: Carrier Corporation, Syracuse, N.Y.

[21] Appl. No.: 437,730

[22] Filed: Oct. 29, 1982

[51] Int. Cl.[3] ..... F16H 21/18; F04B 35/04

[52] U.S. Cl. ..... 74/50; 417/415; 417/534; 417/902

[58] Field of Search ..... 417/415, 902, 534; 74/50, 55, 54; 92/138, 150

[56] References Cited

U.S. PATENT DOCUMENTS

| | | | |
|---|---|---|---|
| 1,073,656 | 9/1913 | Barker | 74/50 |
| 2,366,237 | 1/1945 | Clausen | 74/50 |
| 4,373,876 | 2/1983 | Nemoto | 417/534 |
| 4,406,592 | 9/1983 | Kropiwnicki | 417/902 X |

FOREIGN PATENT DOCUMENTS

| | | | |
|---|---|---|---|
| 56-113078 | 9/1981 | Japan | 417/534 |

*Primary Examiner*—Richard E. Gluck
*Assistant Examiner*—T. Olds
*Attorney, Agent, or Firm*—David J. Zobkiw

[57] ABSTRACT

A motor-compressor unit comprising a shell, a compressor, and a motor. The compressor includes a yoke and a slide block to transmit motion from a compressor crankshaft to a plurality of compressor pistons. The yoke includes left and right longitudinally extending side wall portions, and upper and lower front and rear connecting portions secured to and transversely extending between the left and right side wall portions. The upper and lower front connecting portions define a front transverse opening, and the upper and lower rear connecting portions define a rear transverse opening. The slide block is supported by the yoke for longitudinal sliding movement through the front and rear transverse openings.

4 Claims, 5 Drawing Figures

MOTOR-COMPRESSOR UNIT

BACKGROUND OF THE INVENTION

This invention generally relates to motor-compressor units, and more specifically to motor-compressor units employing a yoke and a slide block to transmit motion from a compressor crankshaft to a pair of opposed compressor pistons, and to a yoke and slide block combination especially well suited for use in certain motor-compressor units.

The utilization of hermetically and semi-hermetically sealed motor-compressor units has become increasingly prevelant in recent years, particularly in refrigeration applications where the motor-compressor units are employed to compress refrigerant vapor. Typically, a motor-compressor unit includes a compressor, a motor, and a shell enclosing both the compressor and the motor; and the compressor, in turn, includes a rotatable crankshaft and a plurality of pistons, with each piston connected to the crankshaft via a conventional wrist pin and connecting arm. In operation, the shell is filled with low pressure suction vapor, the motor is employed to rotate the compressor crankshaft, and rotation of the crankshaft reciprocates the compressor pistons via the wrist pins and connecting arms. Reciprocating movement of the compressor pistons draws the low pressure vapor into the compressor, compresses the vapor, and then directs the vapor into a high pressure discharge line that conducts the compressed vapor from the compresor and through the shell of the motor-compressor unit.

While these conventional prior art motor-compressor units operate very satisfactory under a wide variety of circumstances, efforts have continuously been made to improve the efficiency of motor-compressor units, and recently these efforts have resulted in the design of a revolutionary new type of motor-compressor unit having, inter alia, a large central region which, during operation, is filled with high pressure, compressed vapor. During the development of this new motor-compressor unit, it was learned that when the conventional wrist pin-connecting arm arrangement is used to connect the compressor pistons with the compressor crankshaft, under certain circumstances, the wrist pins are not lubricated as easily as or to the extent desired. For this reason, the new type of motor-compressor unit is provided with a yoke and a slide block to connect and to transmit motion from the compressor crankshaft to the compressor pistons.

Providing the new type of motor-compressor unit with prior art yoke-slide block arrangements, however, involves a perplexing dilemma. To elaborate, to reduce the cost and improve the performance of the motor-compressor unit, it is desirable to use a comparatively small, low mass yoke; and this may be done by employing a yoke having two, opposed, closed longitudinal sides and two, opposed, open transverse sides. In assembly, the compressor pistons are connected to the closed sides of the yoke and a slide block is supported by the yoke for longitudinal movement through the open sides thereof. Such a yoke, often referred to as an open yoke, does not limit longitudinal movement of the slide block, allowing the use of a compact, light weight yoke.

With the new type of motor-compressor unit outlined above, the high pressure vapor in the central region of the motor-compressor unit urges the compressor pistons outward. When prior art open yokes are employed with this new type of motor-compressor unit, the forces urging the pistons outward tend to bend the closed sides of the yoke outward. This bending may cause the pistons connected to the yoke to bind against adjacent surfaces of the compressor, increasing the frictional forces therebetween and otherwise adversely affecting performance of the motor-compressor unit. Of course, this bending can be inhibited by employing a yoke having four closed sides or by employing a more massive, stronger yoke; but doing this increases the size, inertia, and cost of the yoke.

SUMMARY OF THE INVENTION

An object of the present invention is to provide a motor-compressor unit of the type having a central region that, during operation, is filled with high pressure vapor, with a small, low mass, open yoke to connect and transmit motion from a compressor crankshaft to a plurality of compressor pistons.

Another object of this invention is to provide a motor-compressor unit with a symmetrical, open yoke well adapted to allow sliding movement of a slide block through the open sides of the yoke.

These and other objects are attained with a motor-compressor unit comprising a shell, a compressor, and a motor. The compressor includes a yoke and a slide block to transmit motion from a compressor crankshaft to a plurality of compressor pistons. The yoke includes left and right longitudinally extending side wall portions, and upper and lower front and rear connecting portions secured to and transversely extending between the side wall portions. The upper and lower front connecting portions define a front transverse opening, and the upper and lower rear connecting portions define a rear transverse opening. The slide block is supported by the yoke, adjacent and between the left and right side wall portions thereof, for longitudinal sliding movement through the front and rear transverse openings.

DETAILED DESCRIPTION OF THE PREFERRED EMBODIMENT

Figure 1:
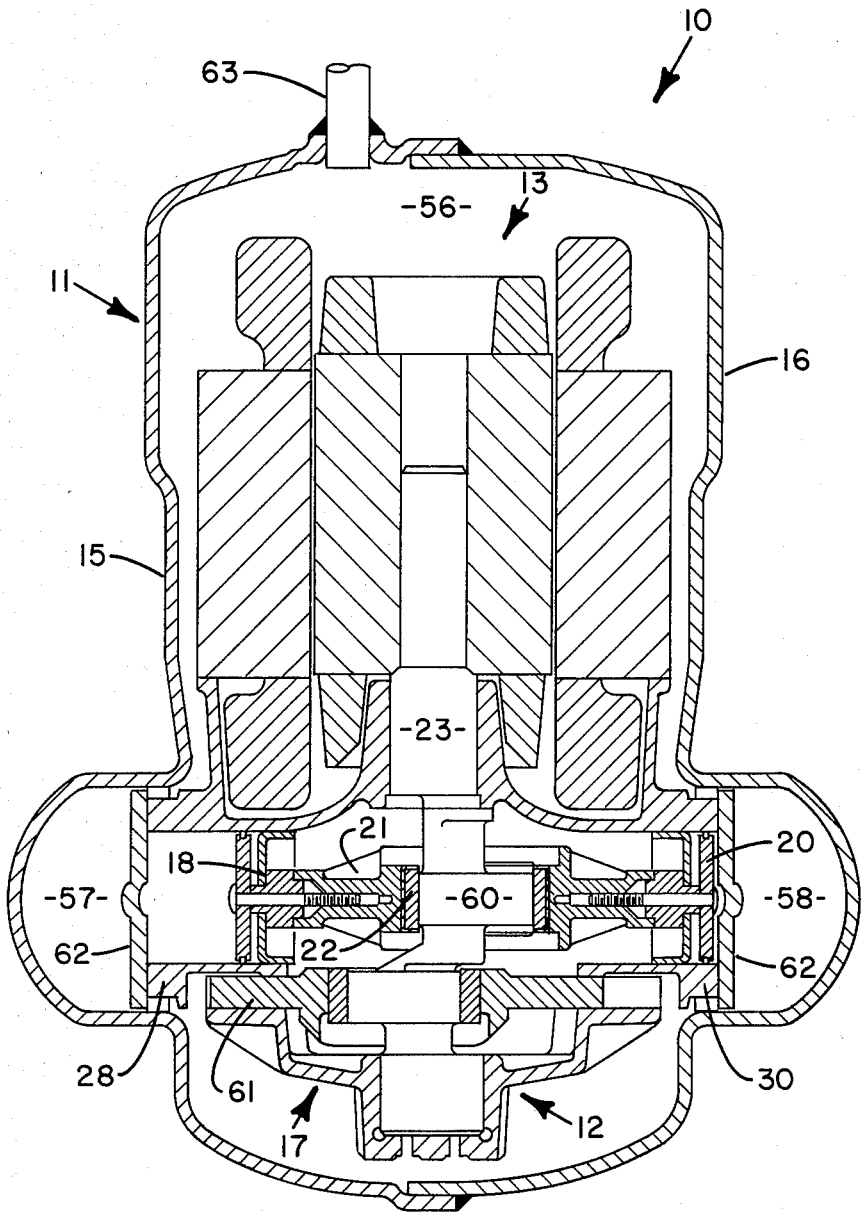
FIG. 1 is a front view, primarily in cross section, of a motor-compressor unit illustrating teachings of the present invention.
Figure 2:
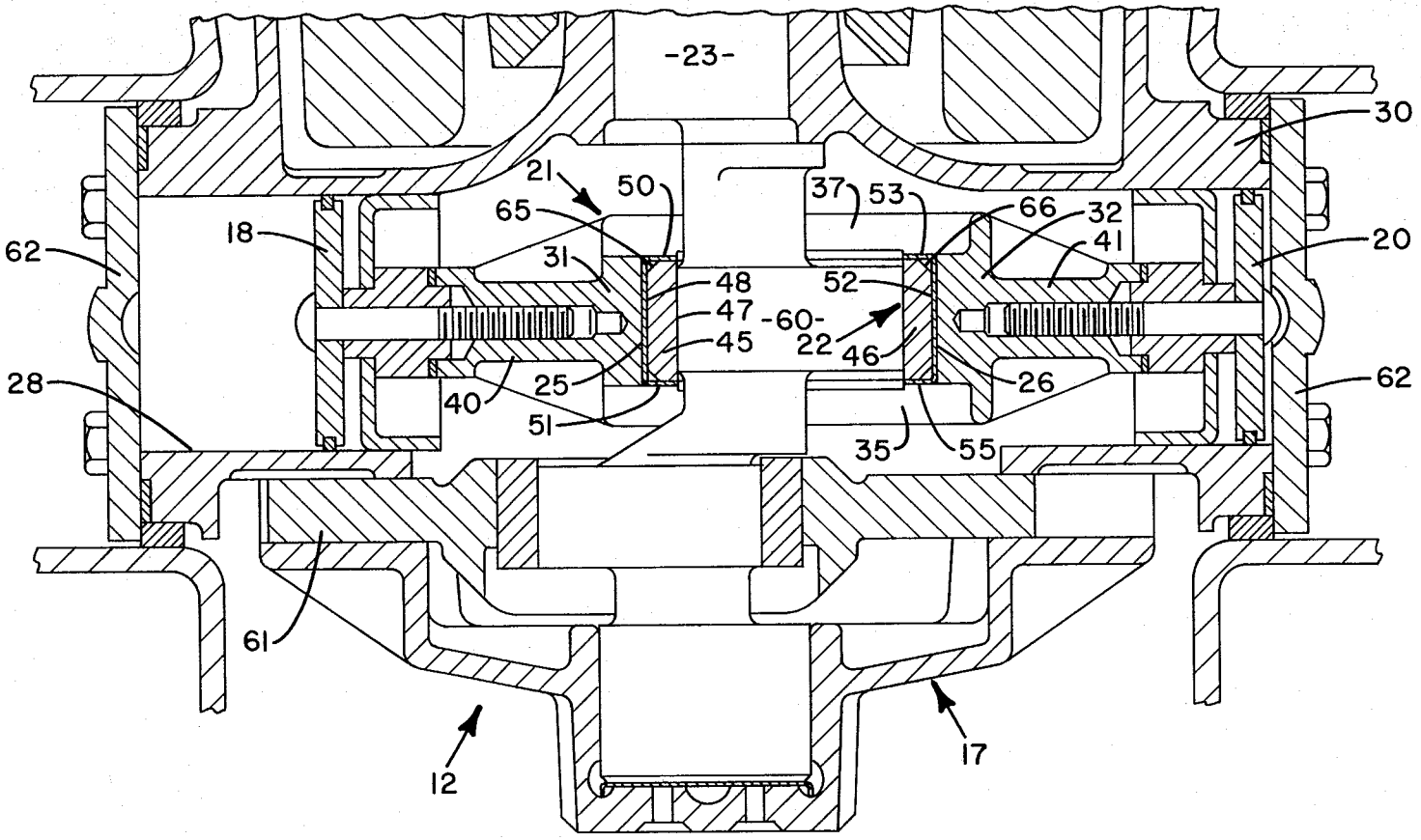
FIG. 2 is an enlarged view of portions of FIG. 1.

FIG. 1 discloses motor-compressor unit 10 constructed in accordance with a preferred embodiment of the present invention. Unit 10 generally includes shell 11, compressor 12, and motor 13. More specifically, shell 11 includes substantially identical, vertically split, first and second shell halves or sections 15 and 16. Referring to FIGS. 1 and 2, compressor 12 includes cylinder block 17, left and right pistons 18 and 20, yoke 21, slide block 22, and crankshaft 23, and preferably the compressor further comprises left and right slide block bearings 25 and 26. Cylinder block 17, in turn, comprises a central body and left and right cylinder portions 28 and 30.

Figure 3:
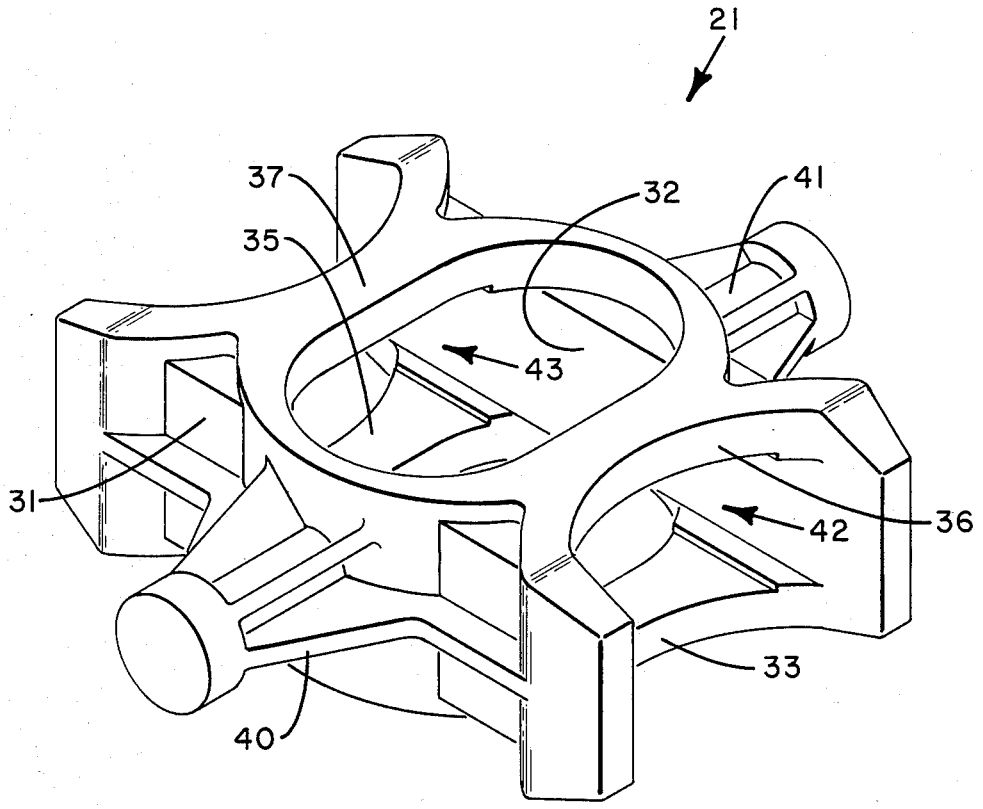
FIG. 3 is an isometric view of the yoke employed with the motor-compressor unit shown in FIG. 1.
Figure 4:
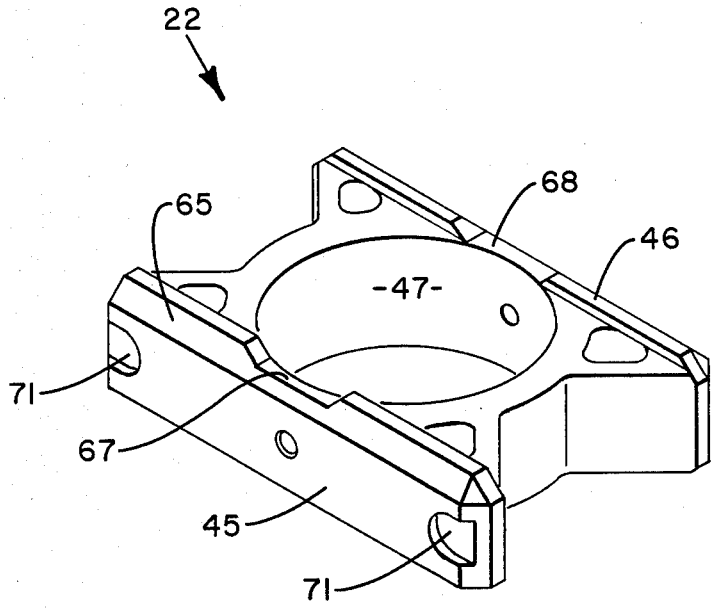
FIG. 4 is an isometric view of the slide block of the motor-compressor.

Particularly referring now to FIGS. 2 and 3, yoke 21 comprises longitudinally extending left and right side wall portions 31 and 32, lower front and rear connecting portions 33 and 35, and upper front and rear connection portions 36 and 37. Yoke 25 further includes left and right arm portions 40 and 41 and defines front and rear transverse openings 42 and 43. Turning to FIGS. 2 and 4, slide block 22 includes left and right longitudinally extending shoulders 45 and 46 and defines central, circular opening 47; and with reference to FIGS. 2 and 5, left slide block bearing 25 includes left side bearing surface 48, upper flange portion 50, and lower flange portion 51; and, analogously, right slide block bearing 26 includes right side bearing surface 52, upper flange portion 53, and lower flange portion 55.

Again primarily referring to FIG. 1, in assembly, shell sections 15 and 16 slightly overlap and are joined together, for example by welding, along a seam defining a vertical plane. As so formed, shell 11 includes a relatively large central or head portion and two relatively small, generally semi-spherically shaped outside or ear portions projecting outward from opposed, lower, outside areas of the head portion of the shell. Compressor 12 is supported within shell 11 to compress a vapor and separates the shell into a central, high pressure vapor region 56 and left and right opposed, peripheral low pressure vapor regions 57 and 58. In particular, cylinder portions 28 and 30 of cylinder block 17 extend within the ear portions of shell 11, adjacent interior surfaces thereof, separating the shell into regions 56, 57, and 58. Seals may be disposed between cylinder portions 28 and 30 and adjacent surfaces of shell 11 to inhibit vapor flow past the exterior of the cylinder portions and adjacent surfaces of the shell and to inhibit heat transfer between region 56 and regions 57 and 58.

Pistons 18 and 20 are disposed within cylinder portions 28 and 30 of cylinder block 17 and are supported by the cylinder block for reciprocal movement within the first and second cylinder portions. Yoke 21 is supported within central region 56 of shell 11 and is connected to first and second pistons 18 and 20. Yoke 21 is described in more detail below. Generally, though, left and right side wall portions 31 and 32 of yoke 21 are parallel to and spaced from each other, arms 40 and 41 of the yoke are connected to and transversely extend outward (that is, away from the center of the yoke) from the longitudinal side wall portions of the yoke, and pistons 18 and 20 are connected to and extend outward from arms 40 and 41. Slide block 22 is supported by yoke 21, adjacent to and between left and right side wall portions 31 and 32 thereof, for longitudinal sliding movement through front and rear transverse openings 42 and 43 defined by the yoke. Preferably, left and right shoulders 45 and 46 of slide block 22 are parallel to and in a close sliding fit with side wall portions 31 and 32 of yoke 21.

Compressor crankshaft 23 is rotatably supported by cylinder block 17 and engages slide block 22 to reciprocate the slide block and yoke 21. In particular, compressor crankshaft 23 axially extends through cylinder block 17 and through central opening 47 of slide block 22; and the crankshaft includes eccentric or off center portion 60 located within the central opening of the slide block, in a close, sliding fit with the surfaces of the slide block defining the central opening thereof. Motor 13, which may be a conventional electric motor, is supported within shell 11 and is connected to compressor crankshaft 23 to rotate the crankshaft. Preferably, motor 13 is also connected to, supported by, and located above cylinder block 17 of compressor 12.

In the preferred operation of motor-compressor unit 10, low pressure vapor is conducted into low pressure regions 57 and 58, and motor 13 is actuated to rotate compressor crankshaft 23. Rotation of crankshaft 23 reciprocates slide block 22 simultaneously in the longitudinal and transverse directions. Longitudinal reciprocating movement of slide block 22 simply causes the slide block to slide along side wall portions 32 and 33 of yoke 21, through transverse openings 42 and 43 thereof, and does not, by itself, result in any movement of the yoke. Transverse reciprocating movement of slide block 22, however, causes yoke 21 to reciprocate transversely, causing pistons 18 and 20 to reciprocate within piston cylinders 28 and 30. A reciprocating counterweight 61 may also be connected to compressor crankshaft 23 to move opposite pistons 18 and 20, tending to balance the pistons as they reciprocate within cylinder portions 28 and 30.

As pistons 18 and 20 so reciprocate, vapor is drawn into cylinder portions 28 and 30 from low pressure regions 57 and 58 via valve plates 62, compressed within the cylinder portions, and discharged therefrom through the pistons and into the central, high pressure region 56 of shell 11. Therefrom, the compressed vapor passes upward through central region 56 and is discharged from shell 11 via outlet line 63. As will be understood by those skilled in the art, suction valves (not shown) may be located adjacent valve plates 62 to control the flow of low pressure vapor into cylinder portions 28 and 30, and discharge valves (also not shown) may be mounted on pistons 18 and 20 to control the flow of compressed vapor therethrough.

With this operation of motor-compressor unit 10, an outside face of left piston 18 is exposed to the suction vapor in left cylinder portion 28 of compressor 12, while an inside face of the left piston is exposed to the discharge vapor in central region 56 of shell 16. Similarly, an outside face of right piston 20 is exposed to the suction vapor in right cylinder portion 30, while an inside face of the right piston is exposed to the discharge vapor in central region 56 of shell 16. Since, for most of the time during each reciprocating cycle of each piston 18 and 20, the discharge vapor in central region 56 of shell 16 has a greater pressure than the suction pressure in cylinder portions 28 and 30, the net pressure force on left and right pistons 18 and 20 urges the pistons outward, away from yoke 21.

Left arm portion 40 transmits the net pressure force on left piston 18 to left side wall portion 31, and right arm portion 41 transmits the net pressure force on right piston 20 to right side wall portion 32. These forces generate outward bending moments on left and right side wall portions 31 and 32, relative to the top or bottom ends thereof. With prior art yokes having open transverse sides, these bending moments tend to bend the top regions of the longitudinal side wall portions of the yoke outward, and this tends to pivot the top portions of pistons 18 and 20 outward, adversely affecting movement thereof. In accordance with teachings of the present invention, yoke 21 is well designed to maintain its shape and withstand the bending moment thereon while, at the same time, the yoke is relatively small and light and is well adapted to allow sliding movement of slide block 22 through the open transverse sides of the yoke.

Discussing yoke 21 in greater detail, side wall portions 31 and 32 are connected to and spaced from each other by lower front and rear connecting portions 33 and 35 and upper front and rear connecting portions 36 and 37. That is, lower front connecting portion 33 is secured to and transversely extends between lower front regions of the left and right side wall portions 31 and 32, and lower rear connecting portion 35 is secured to and transversely extends between lower rear regions of the left and right side wall portions. Similarly, upper front connecting portion 36 is secured to and transversely extends between upper front regions of left and right side wall portions 31 and 32, and upper rear connecting portion 37 is secured to and transversely extends between upper rear regions of the left and right side wall portions. Upper and lower front connecting portions 36 and 37 are spaced apart defining front, transverse opening 42 therebetween; and upper and lower rear connecting portions 38 and 39 are spaced apart, defining rear, transverse opening 43 therebetween. It should be noted that yoke 21 may comprise a single, unitary piece of material, with the various portions of the yoke, including arms 40 and 41, integral with each other.

During the operation of motor-compressor unit 10, lower front, lower rear, upper front, and upper rear connecting portions 33, 35, 36, and 37 transmit the force on left side wall portion 31 of yoke 21, due to the net outward pressure forces on left piston 18, to right side wall portion 32 of the yoke to balance the force and the bending moment on the right side wall portion due to the net outward pressure forces on right piston 20. Also, lower front, lower rear, upper front, and upper rear connecting portions 33, 35, 36, and 37 transmit the force on right side wall portion 32 of yoke 21, due to the net outward pressure forces on right piston 20, to left side wall portion 31 of the yoke to balance the force and the bending moment on the left side wall portion due to the net outward pressure forces on left piston 18. By balancing the forces and the bending moments on left and right side wall portions 31 and 32, connecting portions 33, 35, 36, and 37 may be easily and effectively employed to prevent these forces and the associated bending moments from actually bending outward the left and right side wall portions. At the same time, upper front and rear connecting portions 36 and 37, being spaced from lower front and rear connecting portions 33 and 35 as shown in the drawings, do not limit longitudinal movement of slide block 22.

Left and right slide block bearings 25 and 26 are disposed between adjacent surfaces of yoke 21 and slide block 22 to facilitate relative sliding movement therebetween. In particular, as is believed best understood with reference to FIGS. 2 and 5, left slide block bearing 25 is secured to left side wall portion 31 of yoke 21, with left bearing surface 48 disposed between the left side wall portion and left shoulder 45 of slide block 22. Upper flange portion 50 of bearing 25 is integral with and transversely extends inward from an upper edge of left bearing surface 48, between left shoulder 45 of slide block 22 and upper front and rear connecting portions 36 and 37; and lower flange portion 50 of the left slide block bearing is integral with and transversely extends inward from a lower edge of the left bearing surface, between the left shoulder of the slide block and lower front and rear connecting portions 33 and 35. Similarly, right slide block bearing 26 is secured to right side wall portion 32 of yoke 21, with right side bearing surface 52 disposed between the right side wall portion and right shoulder 46 of slide block 22. Upper flange portion 53 of right slide block bearing 26 is integral with and transversely extends inward from an upper edge of right bearing surface 52, between right shoulder 46 of slide block 22 and upper front and rear connecting portions 36 and 37; and lower flange portion 55 of the right slide block bearing is integral with and transversely extends inward from a lower edge of the right side bearing surface, between the right shoulder of the slide block and lower front and rear connecting portions 33 and 35.

Preferably, the upper flange portions of left and right slide block bearings 25 and 26 also longitudinally project inward of, and may longitudinally project completely between, upper front and rear connecting portions 36 and 37; and lower flange portions of the left and right slide block bearings longitudinally project inward of, and may longitudinally project completely between, lower front and rear connecting portions 33 and 35. In this way, bearings 25 and 26 not only facilitate relative sliding movement between yoke 21 and slide block 22, but also guide movement of the slide block into and through front and rear transverse openings 42 and 43.

Preferably, a close, sliding fit is maintained between slide block 22 and bearings 25 and 26, and the slide block is provided with various chamfered surfaces to facilitate relative movement between and lubrication of adjacent or contiguous surfaces of the slide block and the slide block bearings. More particularly, during various types of operation such as in a refrigeration circuit, a supply of lubricant is located at the bottom of shell 11, and lubricant is conducted upward therefrom through or along crankshaft 23 and thrown radially outward thereby. This lubricant, as well as lubricant entrained in the vapor passing through motor-compressor unit 10, flows through cylinder block 17, and slide block 22 defines several chamfered surfaces to conduct lubricant passing through the cylinder block between the slide block and left and right bearings 25 and 26.

Specifically, with reference to FIGS. 2 and 4, left shoulder 45 of slide block 22 defines top left chamfered edge 65, which longitudinally extends between front and rear faces of the left shoulder of the slide block, and right shoulder 46 of the slide block defines top right chamfered edge 66, which longitudinally extends between front and rear faces of the right shoulder of the slide block. In assembly, left rail bearing 25 and left chamfered edge 65 of slide block 22 define a left lubricant channel to conduct lubricant, which is passing through cylinder block 17, between the left rail bearing and left shoulder 45 of the slide block; and right rail bearing 26 and right chamfered edge 66 define a right lubricant channel to conduct lubricant between the right rail bearing and right shoulder 46 of the slide block.

Analogous to chamfered edges 65 and 66, slide block 22 may also define bottom left and bottom right, longitudinally extending chamfered edges, with these edges and left and right rail bearings 25 and 26 defining additional left and right lubricant channels also to conduct lubricant between the rail bearings and left and right shoulders 45 and 46 of slide block 22.

To insure adequate lubrication between slide block 22 and central portions of left and right rail bearings 25 and 26, preferably top surfaces of left and right shoulders 45 and 46 of the slide block define left and right, top, central recesses 67 and 68. These recesses 67 and 68 transversely extend between central opening 47 of slide block 22 and central portions of the top left and top right lubricant channels, respectively, to conduct lubricant, which has been conducted upward through crankshaft 23 to the central opening of the slide block, between that central opening and the left and right lubricant channels. Additional recesses, similar to central recesses 67 and 68, may also be defined by the bottom surfaces of left and right shoulders 45 and 46 of slide block 22.

Figure 5:
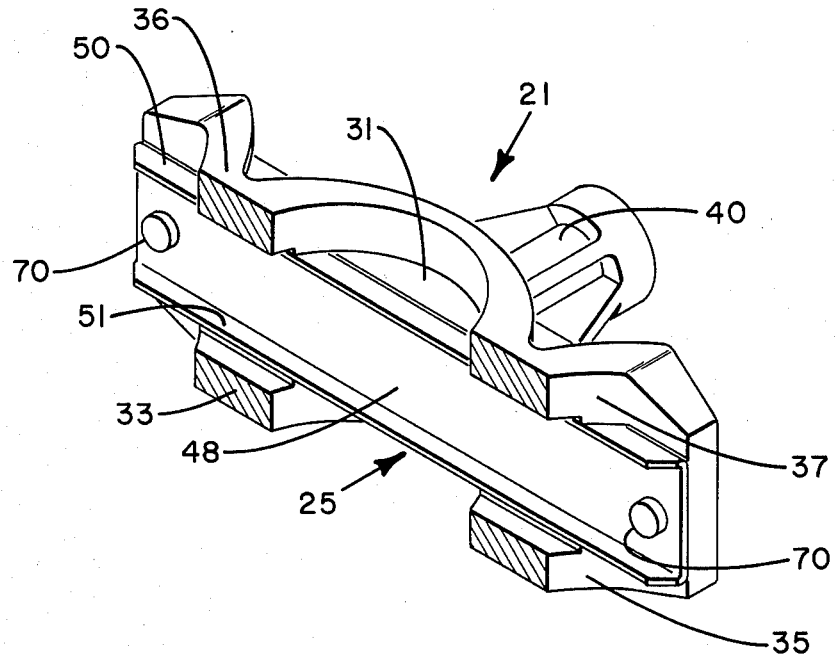
FIG. 5 is a partial isometric view showing a slide block bearing secured to the yoke of the motor-compressor unit.

Compressor 12 may further comprise a plurality of rivets to secure slide block bearings 25 and 26 to side wall portions 31 and 32 of yoke 21. To elaborate, as shown in FIG. 5, a pair of left rivets 70 extend through left side bearing surface 48 of left slide block bearing 25, into left side wall portion 31 to secure the left slide block bearing thereto. Similarly, a pair of right rivets extend through right side bearing surface 52 of right slide block bearing 26, into right side wall portion 32 to secure the right slide block bearing thereto. Each of these rivets includes a rivet head that, in assembly, transversely extend inward from the left and right side bearing surfaces 48 and 52 of left and right slide block bearings 25 and 26 respectively.

In order to allow slide block 22 to move past the heads of the left and right rivets, the slide block, specifically left and right shoulders 45 and 46, define a pair of left rivet recesses 71 (shown in FIG. 4) and a corresponding pair of right rivet recesses, extending inward from outside surfaces of the left and right shoulders respectively, to receive the left and right rivet heads as the slide block slides therepast.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A yoke and slide block combination comprising:

a yoke including a left longitudinally extending side wall portion, a right longitudinally extending side wall portion spaced from the left side wall portion, a lower front connecting portion secured to and transversely extending between lower front regions of the left and right side wall portions, an upper front connecting portion secured to and transversely extending between upper front regions of the left and right side wall portions and spaced from the lower front connecting portion, the upper and lower front connecting portion, the upper and lower front connecting portions defining a front transverse opening therebetween, a lower rear connecting portion secured to and transversely extending between lower rear regions of the left and right side wall portions, and an upper rear connecting portion secured to and transversely extending between upper rear regions of the left and right side wall portions and spaced from the lower rear connecting portion, the upper and lower rear connecting portions defining a rear transverse opening therebetween;

a slide block supported by the yoke, between the left and right side wall portions, for longitudinally sliding movement through the front and rear transverse openings, and including a left shoulder extending parallel and adjacent to the left side wall portion of the yoke, and a right shoulder extending parallel and adjacent to the right side wall portion of the yoke;

a left rail bearing secured to the left side wall portion of the yoke to facilitate sliding movement between the slide block and the yoke, and including a left bearing surface disposed between the left side wall portion of the yoke and the left shoulder of the slide block, an upper flange portion integral with and extending inward from an upper edge of the left bearing surface, between the left shoulder of the slide block and the upper front and rear connecting portions of the yoke, and a lower flange portion integral with and extending inward from a lower edge of the left bearing surface, between the left shoulder of the slide block and the lower front and rear connecting portions of the yoke; and a right rail bearing secured to the right side wall portion of the yoke to facilitate sliding movement between the slide block and the yoke, and including a right bearing surface disposed between the right side wall portion of the yoke and the right shoulder of the slide block, an upper flange portion integral with and extending inward from an upper edge of the right bearing surface, between the right shoulder of the slide block and the upper front and rear connecting portions of the yoke, and a lower flange portion integral with and extending inward from a lower edge of the right bearing surface, between the right shoulder of the slide block and the lower front and rear connecting portions of the yoke.

2. The combination yoke and slide block as defined by claim 1 wherein:

the upper flange portion of the left rail bearing longitudinally projects inward of the upper front and rear connecting portions of the yoke;

the lower flange portion of the left rail bearing longitudinally projects inward of the lower front and rear connecting portions of the yoke;

the upper flange portion of the right rail bearing longitudinally projects inward of the upper front and rear connecting portions of the yoke; and the lower flange portion of the right rail bearing longitudinally projects inward of the lower front and rear connecting portions of the yoke;

wherein the rail bearings guide movement of the slide block into and through the front and rear transverse openings of the yoke.

3. The combination slide block and yoke as defined by claim 2 wherein:

the left shoulder of the slide block defines a left chamfered edge longitudinally extending between front and rear faces of the left shoulder, the left rail bearing and the left chamfered edge defining a left lubricant channel to conduct lubricant between the left rail bearing and the left shoulder of the slide block; and the right shoulder of the slide block defines a right chamfered edge longitudinally extending between front and rear faces of the right shoulder to conduct lubricant between the right rail bearing and right shoulder of the slide block.

4. The combination slide block and yoke as defined by claim 3 wherein:

the slide block defines a central opening;

the left shoulder of the slide block further defines a left, central recess transversely extending between the central opening and central portions of the left lubricant channel to conduct lubricant therebetween; and the right shoulder of the slide block further defines a right, central recess transversely extending between the central opening and central portions of the right lubricant channel to conduct lubricant therebetween.

* * * * *